United States Patent [19]

Chandler

[11] Patent Number: 4,824,038

[45] Date of Patent: Apr. 25, 1989

[54] HOLDER FOR ROLLED PAPER

[76] Inventor: Jerry W. Chandler, 48 Upland Dr., Salem, Va. 24153

[21] Appl. No.: 202,463

[22] Filed: Jun. 6, 1988

Related U.S. Application Data

[63] Continuation-in-part of Ser. No. 37,341, Apr. 13, 1987, abandoned.

[51] Int. Cl.[4] ..... B65H 19/00

[52] U.S. Cl. ..... 242/55.2; 242/55.54

[58] Field of Search ..... 242/55.2, 55.54, 129.5, 242/129.6; D6/518, 522, 523

[56] References Cited

U.S. PATENT DOCUMENTS

| | | | |
|---|---|---|---|
| 1,663,305 | 3/1928 | Hudson | 242/55.2 |
| 2,410,328 | 10/1946 | Agamaite, Jr. | 242/55.2 |
| 2,517,809 | 8/1950 | Tarzian | 242/55.2 |
| 4,071,200 | 1/1978 | Stone | 242/55.2 |
| 4,662,576 | 5/1987 | Beeken | 242/55.53 X |

*Primary Examiner*—David Werner

*Attorney, Agent, or Firm*—Norman B. Rainer

[57] ABSTRACT

A holder for a roll of toilet paper is comprised of a frame adapted to be attached to a vertical support wall, and a cylindrical core which pivotably engages the lower extremity of the frame. The core can be swung in a vertical path between a vertical position and a horizontal position, and can be removed from the frame. Retaining structure holds the non-pivoted extremity of the core in vertical position within the frame.

10 Claims, 3 Drawing Sheets

HOLDER FOR ROLLED PAPER

RELATED APPLICATIONS

This application is a continuation-in-part of U.S. patent application Ser. No. 037,341, filed 04/13/87 now abandoned.

BACKGROUND OF THE INVENTION

This invention concerns a holder for a cylindrical roll of toilet paper where various lengths are torn from the roll along perforations parallel to the axis of the roll.

A popular type of holder for toilet paper rolls consists of a receptacle or housing, usually of semi-cylindrical form recessed into a wall and having in its opposite interior faces sockets or slots to receive the ends of a horizontally disposed journal rod or core upon which the paper roll is mounted. Because of its recessed position, the removal of paper from the roll is sometimes awkward, particularly when the holder is in a wall at one side of the toilet bowl, causing the axis of rotation of the roll to be substantially parallel to the general direction of arm reach of the user.

It is accordingly an object of the present invention to provide a holder for toilet tissue which facilitates removal of paper from the roll.

It is another object of this invention to provide a holder as in the foregoing object adapted to be mounted upon or recessed into a wall adjacent a toilet bowl.

It is a further object of this invention to provide a holder of the aforesaid nature which selectively disposes the rotational axis of the roll either horizontally or vertically within a plane generally perpendicular to the direction of arm reach of the user.

It is still another object of the present invention to provide a holder of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a holder comprising:

(a) a generally U-shaped frame having a base portion and opposed parallel upper and lower arms perpendicularly emergent from said base portion and extending to distal extremities, said base portion having mounting means, the distal extremity of said upper arm having retaining means, and the distal extremity of said lower arm having first pivot means, (b) a cylindrical core having attached and free extremities, a flange located at said free extremity in perpendicular disposition to the axis of said core, and release means axially centered upon said flange, (c) second pivot means associated with said attached extremity and interactive with said first pivot means in a manner to dispose said core vertically substantially within the boundaries of said frame while locked in said disposition by engagement of said release means with said retaining means, and enabling said core to be rotated 90 degrees downwardly about said pivot means to a downward horizontal disposition coextensive with said lower arm, and (d) abutment means interactive between said lower arm and said cylindrical core to provide structural stability of said core in its horizontal disposition.

The frame is preferably of monolithic construction, fabricated of rigid material such as wood, plastic, metal or ceramic. The flange is preferably removable from the free extremity of the core to permit replacement of rolls of paper. The retaining means in the upper arm may be an aperture, springs, mechanically engaging projections, or magnetic devices. The release means associated with the flange may be a spring loaded plunger, or other mechanisms interactive with said retaining means. The first and second pivot means may be comprised of an elongated pivot rod and structure for journaled retention of said pivot rod.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
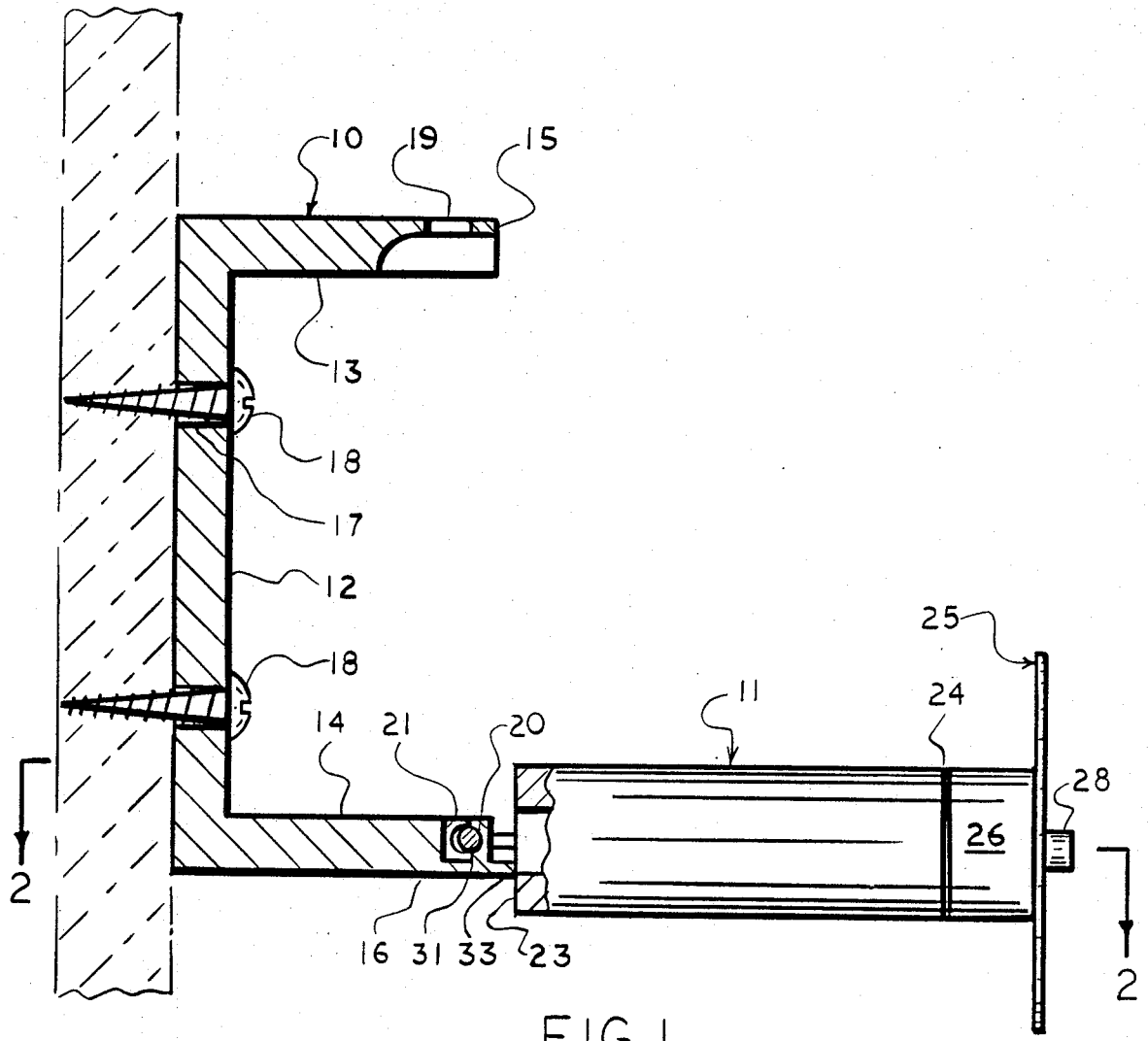
FIG. 1 is a side view, partially in section, of an embodiment of the roll paper holder of the present invention showing the core in its horizontal position.
Figure 2:
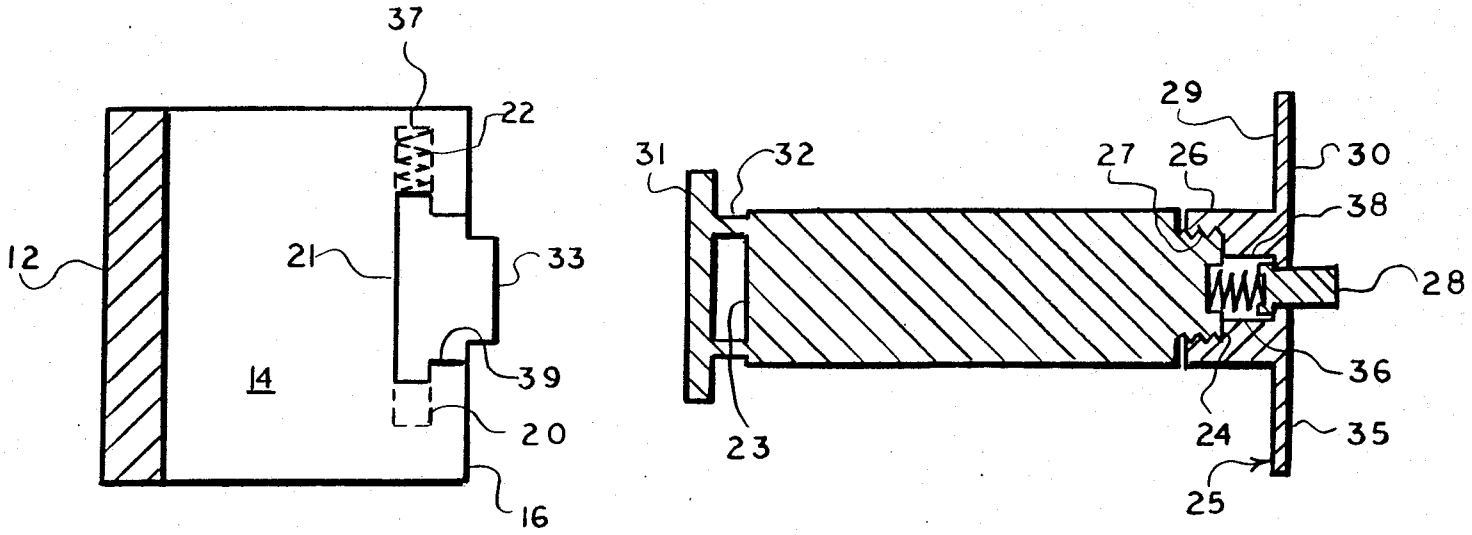
FIG. 2 is a partially exploded sectional view taken upon the line 2—2 of FIG. 1.
Figure 3:
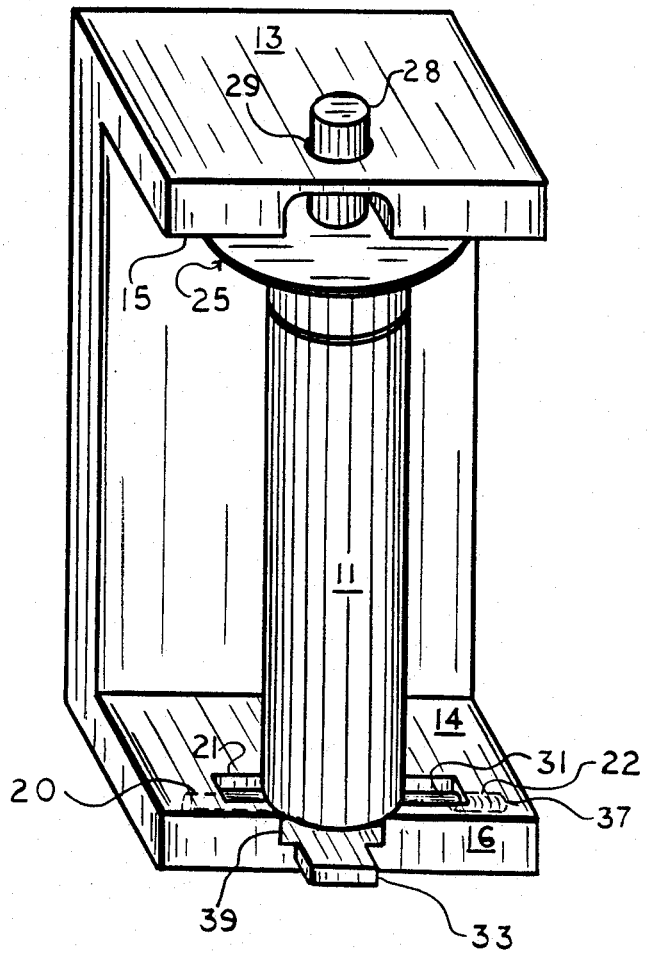
FIG. 3 is a front perspective view of the embodiment showing the core in its upright position.

Referring to FIGS. 1–3, an embodiment of the roll paper holder of the present invention is shown comprised of frame 10 and cylindrical core 11.

Frame 10 is of substantially monolithic construction, having a generally U-shaped configuration comprised of base portion 12 and opposed parallel upper and lower arms 13 and 14, respectively, perpendicularly emergent from said base portion, and extending to vertically aligned distal forward extremities 15 and 16. The base portion is provided with mounting means in the form of two apertures 17 adapted to accommodate screws 18 intended to engage a vertical wall structure.

The distal extremity 15 of said upper arm is provided with retaining means in the form of aperture 19 whose function will be detailed hereinafter. The distal extremity 16 of said lower arm is provided with first pivot means in the form of paired holding sockets 20 and 37 of generally cylindrical contour in spaced apart horizontal alignment across recess 21, Socket 37 is of slightly larger diameter than the diameter of socket 20, and its closed extremity is further enlarged in a downward direction and provided with coil spring 22.

Core 11 has attached and free extremities, 23 and 24, respectively. A flat circular flange 25 is located at said free extremity in perpendicular disposition to the cylindrical axis of said core. Flange 25 is associated with threaded cap 26 affixed to the inside face 29 of the flange and adapted to engage a threaded zone 27 contiguous to free extremity 24. Release means in the form of plunger 28 is axially disposed upon outside face 30 of flange 25 and is adapted to be depressible in the direction of the core against the urging of coil spring 36 held by cavity 38 centered within cap 26. As shown in FIG.

3, plunger 28, in its outwardly urged state, is adapted to engage retaining aperture 19 in the upper arm when the core is in its vertical position.

Second pivot means, in the form of elongated cylindrical pivot rod 31, is attached by paired stand-offs 32 to extremity 23 of the core in a manner such as to be bisected by the axis of said core. Rod 31 is perpendicularly disposed to the core axis and is sufficiently displaced from extremity 23 so as to facilitate passage into holding sockets 20 and 37 of said lower arm.

Rod 31 is removably positionable within sockets 20 and 37 by first entering one end of the rod into enlarged socket 37 having spring 22. A cut-out region 39 extends between recess 21 and the forward face of extremity 16 for the purpose of permitting passage of stand-offs 32. By virtue of the aforesaid components and their interaction, the core is caused to be removably and pivotably attached to the distal extremity 16 of the lower arm in a manner to permit swinging movement about a horizontal axis of rotation defined by the interengaged first and second pivot means in a vertical path between the vertical state shown in FIG. 3 and a horizontal state shown in FIG. 1.

In its horizontal state, the axis of the core is conveniently disposed in substantially perpendicular relationship to the general direction of arm reach of the user. The vertical state of the core is primarily for storage purposes. Abutment means in the form of horizontally disposed strip 33 may be disposed either on the distal extremity 16 of the base, or on extremity 23 of the core for the purpose of maintaining the core in its horizontal position. The exact positioning of said abutment means is interactively dependent upon the configuration and spacing of lower arm 14, extremity 23 of the core, and said first and second pivot means. The effect, however, of the abutment means is to cause the core to be structurally secured in its horizontal position, namely resistant to downward or lateral movement while functioning to dispense tissue.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A holder for a cylindrical roll of spirally wound toilet paper wherein various lengths are torn from the roll along perforations parallel to the axis of the rolle, said holder comprising:

(a) a generally U-shaped frame having a base portion and opposed parallel upper and lower arms perpendicularly emergent from said base portion and extending to distal extremities, said base portion having mounting means, the distal extremity of said upper arm having retaining means, and the distal extremity of said lower arm having first pivot means, and (b) a cylindrical core having attached and free extremities, removable flange means located at said free extremity in perpendicular disposition to the axis of said core, and release means axially centered upon said flange means, (c) second pivot means associated with said attached extremity and interactive with said first pivot means in a manner to define a horizontal axis of rotation and dispose said core vertically substantially within the boundaries of said frame while locked in said disposition by engagement of said release means with said retaining means, and enabling said core to be rotated 90 degrees downwardly about said horizontal axis of rotation to a horizontal disposition coextensive with said lower arm, and (d) abutment means interactive between said lower arm and said cylindrical core to provide structural stability of said core in its horizontal disposition.

2. The holder of claim 1 wherein said frame is of monolithic construction.

3. The holder of claim 1 wherein said flange means is removable from the free extremity of the core, permitting replacement of rolls of paper upon said core.

4. The holder of claim 3 wherein said flange means is threadably removable from said core.

5. The holder of claim 1 wherein said retaining means is comprised of a combination of an aperture, a spring, and a mechanically engaging projection.

6. The holder of claim 1 wherein said release means is a spring loaded plunger.

7. The holder of claim 1 wherein said second pivot means is an elongated rod.

8. The holder of claim 7 wherein said first pivot means is comprised of means for journaled retention of said elongated rod.

9. The holder of claim 8 wherein said means for journaled retention of said elongated rod are paired sockets which releasibly engage said elongated rod.

10. The holder of claim 9 wherein said paired sockets are in aligned opposition across a recess adjacent the distal extremity of said lower arm.

* * * * *